United States Patent [19]

Yoshikawa et al.

[11] Patent Number: 4,982,939

[45] Date of Patent: Jan. 8, 1991

[54] CLAMP DEVICE FOR SHAPED BODIES

[75] Inventors: Akira Yoshikawa, Ohbu; Tsunezo Takeuchi, Chita, both of Japan

[73] Assignee: NGK Insulators, Ltd., Japan

[21] Appl. No.: 300,893

[22] Filed: Jan. 24, 1989

[30] Foreign Application Priority Data

Jan. 27, 1988 [JP] Japan ..... 63-8066[U]

[51] Int. Cl.[5] ..... B25B 1/20

[52] U.S. Cl. ..... 269/32; 269/155; 269/156; 269/258; 269/265; 51/217 R

[58] Field of Search ..... 51/217 R, 217 P, 217 T, 51/217 A; 125/35; 269/32, 155, 156, 258, 265, 286

[56] References Cited

U.S. PATENT DOCUMENTS

| | | | |
|---|---|---|---|
| 3,970,296 | 7/1976 | Rameson | 269/32 |
| 4,228,939 | 10/1980 | Cattaneo . | |
| 4,555,100 | 11/1985 | Ditto | 269/286 X |
| 4,632,374 | 12/1986 | Yang | 269/258 X |

FOREIGN PATENT DOCUMENTS

| | | | |
|---|---|---|---|
| 1528163 | 3/1970 | Fed. Rep. of Germany | 269/265 |
| 3623970 | 1/1988 | Fed. Rep. of Germany . | |
| 986446 | 7/1951 | France | 269/156 |
| 2157203 | 10/1985 | United Kingdom . | |
| 2171035 | 8/1986 | United Kingdom . | |

*Primary Examiner*—Robert A. Rose

*Attorney, Agent, or Firm*—Arnold, White & Durkee

[57] ABSTRACT

There is disclosed a clamp device for clamping a workpiece, e.g. a ceramic shaped body having a surface curvature. Support members are mounted on the base frame to support the workpiece thereon, and are adapted to swing about predetermined rotational axes. First clamp members are mounted on a base frame and adapted to swing about predetermined rotational axes. Second clamp members are mounted on a sub-frame, which is movable relative to the base frame, and are adapted to swing about predetermined rotational axes. The second clamp members can be moved toward the first clamp members to clamp a workpiece therebetween.

10 Claims, 3 Drawing Sheets

CLAMP DEVICE FOR SHAPED BODIES

BACKGROUND OF THE INVENTION

1. Field of the Invention

The present invention relates to a clamp device used to clamp a ceramic, or the like, shaped body when it is cut into a plurality of product pieces.

2. Description of the Related Art

Conventionally, in order to cut a ceramic, or the like, shaped body into two or more product pieces with the length of the product, the shaped body is supported on stationary clamp members, and is then urged downwardly by movable clamp members against the stationary clamp members. The shaped body so clamped in a fixed position is subsequently cut by rotating grinder wheels into a plurality of pieces each having a product length.

The above-mentioned conventional clamp device suffers from disadvantages that, since the clamp members assume a fixed position relative to the shaped body, an undesirable clearance tends to be formed between the shaped body and the clamp members due to the surface curvature of the shaped body resulting from the deformation during the baking step. An adjustment has to be carried out for each shaped body to compensate for or minimize the clearance, e.g. by applying viscous tapes or the like spacer elements, thus requiring time-consuming and troublesome manual operations.

Moreover, even an adjustment as above cannot completely eliminate formation of the clearance and cannot effectively avoid serious problems that, when the cutting is effected by grinder wheels with the tips of the grinder wheel being disengaged from the shaped body after completion of the cutting, the material on the cut end surface of each product piece is excessively removed as a result of the clearance. The excessive removal of the material often results in formation of undesirable play and a hairline-like cutting tool feed pattern on the cut end surface.

SUMMARY OF THE INVENTION

It is therefore a primary object of the present invention to eliminate the above-mentioned drawbacks, by providing a novel clamp device which makes it possible to realize products without an end play or feed patterns on the end surface even when the shaped body has a surface curvature.

According to the present invention, there is provided a workpiece clamp device for a cutting apparatus, comprising a stationary base frame, a movable sub-frame mounted on, and adapted to be moved relative to said base frame, a plurality of first clamp members mounted on said base frame and adapted to swing about respective first rotational axes which are in parallel with each other, a plurality of second clamp members mounted on said sub-frame and adapted to swing about respective second rotational axes which are in parallel with each other and also with said first rotational axes, said sub-frame being movable relative to said base frame such that said second clamp members are moved toward said first clamp members to clamp a workpiece therebetween, and away from said first clamp members to release said workpiece, and a plurality of support members mounted on said base frame to support said workpiece thereon, and adapted to swing about respective third rotational axes extending perpendicularly to said first and second rotational axes.

In the arrangement of the present invention as mentioned above, the clamp members and the support members are adapted to swing about the respective rotational axes, so as to definitely realize the mutual relationship as to their relative positions. Thus, the shaped body can be clamped in good conformity with its surface curvature, and maintained in a stably clamped state without formation of undesirable clearance between the shaped body and the clamp members. This makes it readily possible to effectively achieve a higher productivity and an improved product quality.

The clamp members and the support members may each comprise two integrally arranged resilient shoe elements to prevent slip movement of the shaped body at its contact points with the respective members and thereby to more stably and reliably clamp the shaped body.

DETAILED EXPLANATION OF THE PREFERRED EMBODIMENTS

The present invention will now be explained in further detail, by referring to some preferred embodiments shown in the attached drawings.

Figure 1:
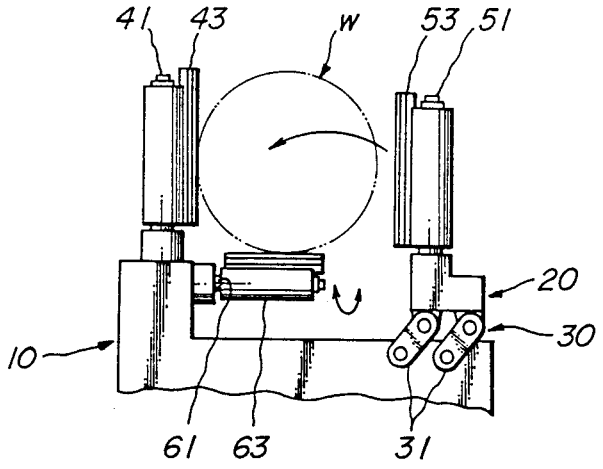
FIGS. 1 and 2 are respectively a front view and top plan view, diagrammatically showing a basic embodiment of the clamp device according to the present invention.
Figure 2:
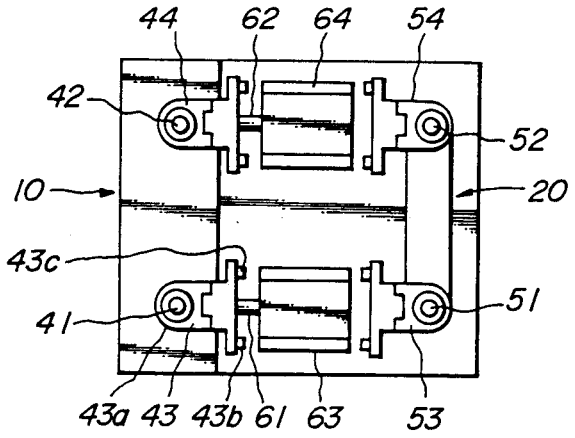

A first embodiment of the clamp device according to the present invention is shown in FIGS. 1 and 2, and includes a stationary base frame 10 and a movable sub-frame 20 mounted on the base frame 10. The sub-frame 20 is associated with an actuator assembly 30 which is adapted to move the sub-frame 20 relative to the base frame 10. The actuator assembly 30 may include a parallel motion link mechanism 31 which is actuated, for example, by a suitable hydraulic or pneumatic cylinder (not shown).

The base frame 10 is provided with two rotational shafts 41, 42 which are in parallel with each other. These shafts 41, 42 serve to rotatably support a pair of clamp members 43, 44, respectively, so that the clamp members 43, 44 are adapted to swing about the respective axes. The sub-frame 20, in turn, is provided with two rotational shafts 51, 52 which are in parallel with each other and also with the shafts 43, 44 for the clamp members 41, 42 on the base frame 10. These shafts 51, 52 serve to rotatably support another pair of clamp members 53, 54, respectively, so that the clamp members 53, 54 are adapted to swing about the respective axes.

By operating the actuator assembly 30, the clamp members 53, 54 on the sub-frame 20 can be moved toward and away from the clamp members 43, 44 on the base frame 10. This makes it possible to clamp a workpiece W between the clamp members 43, 44 and the clamp members 53, 54, and release the workpiece W therefrom.

Moreover, the base frame 10 is provided with two rotational shafts 61, 62 extending perpendicularly to the rotational shafts 41, 42, 51, 52 of the clamp members 43, 44, 53, 54. These shafts 61, 62 serve to rotatably support a pair of support members 63, 64, respectively, so that the support members 63, 64 are adapted to swing about the respective axes to support the workpiece W thereon.

Advantageously, the clamp members 43, 44, 53, 54 and the support members 63, 64 are of basically the same structure. Taking the clamp member 43 for example, it may include a main body 43*a*, and a pair of shoe elements 43*b*, 43*c* of a suitable resilient material integrated into a replaceable unit which is detachably secured to the main body 43*a*.

Figure 3:
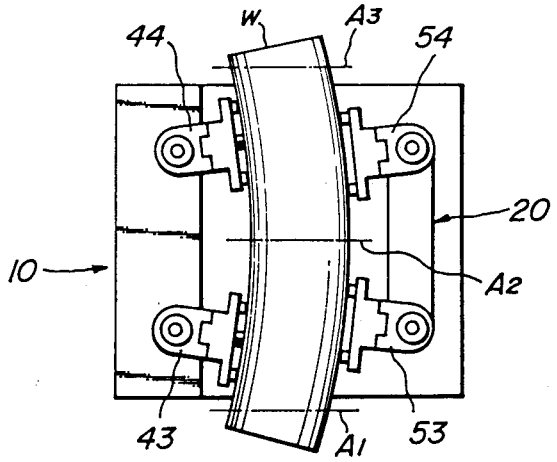
FIG. 3 is a top plan view of the clamp device similar to FIG. 2, but showing the workpiece in its clamped state.

The clamp device as described above is used in the following manner to clamp a workpiece W, which may be a ceramic shaped body already subjected to uneven thermal shrinkage as a result of heat treatment or the like, to have an unintended surface curvature in its longitudinal direction. As particularly shown in FIG. 1, the workpiece W is placed on the support members 63, 64 which are then caused to swing about their respective rotational shafts 61, 62 in conformity with the curvature of the workpiece W. The actuator assembly 30 is subsequently operated so that the sub-frame 20 is moved toward the base frame 10. By this, the clamp members 53, 54 on the sub-frame 20 are moved toward the clamp members 43, 44 on the base frame 10 to clamp the workpiece W therebetween, as shown in FIG. 3. On this occasion, the clamp members 43, 44, 53, 54 are caused to swing about their respective rotational shafts 41, 42, 51, 52 to assume their optimum angular positions relative to the workpiece W in conformity with its curvature. Thus, the workpiece W can be stably clamped in a reliable and facilitated manner, effectively preventing undesirable clearances from being formed between the clamp members 43, 44, 53, 54 and the workpiece W. Moreover, the workpiece W clamped in position as above is prevented from undergoing slips relative to the clamp members 43, 44, 53, 54 and the support members 63, 64, particularly when these members are provided with resilient shoes which are to be resiliently engaged with the workpiece W. It should be noted here that the surface curvature of the workpiece W is shown in FIG. 3 in an exaggerated fashion.

Necessary machining operations can be stably carried out with respect to the workpiece W clamped in position. For example, as shown in FIG. 3, three grinder wheels (not shown) may be applied to the workpiece W along respectively predetermined cutting lines $A_1$, $A_2$, $A_3$ across the workpiece W to cut it into two prOduct pieces. These product pieces can be released from the clamp device by moving the sub-frame 20 away from the base frame 10. In this connection, the sub-frame 20 may be divided into two sections which can be actuated independentlY of the other such that one product piece alone can be released while another product piece is still in a clamped state.

Figure 4:
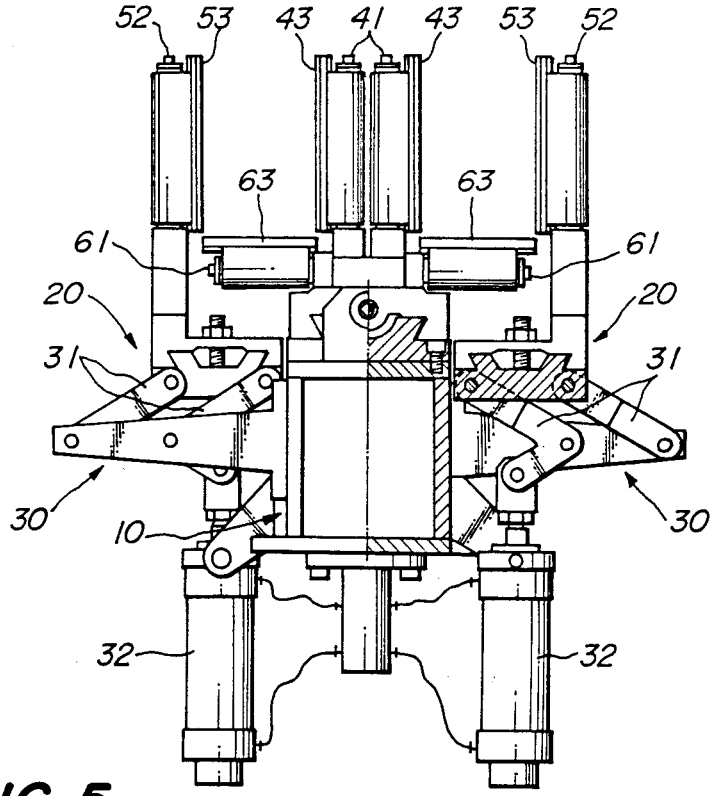
FIGS. 4 and 5 are respectively a front view and top plan view, showing an advanced embodiment of the clamp device according to the present invention.
Figure 5:
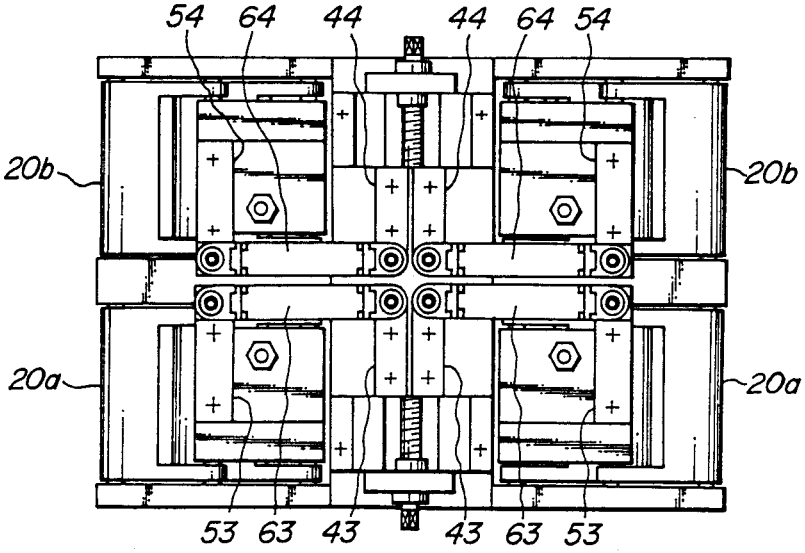

A practical second embodiment of the clamp device according to the present invention is shown in FIGS. 4 and 5. Elements which are the same or equivalent to those already shown in FIGS. 1 and 2 are denoted by the same reference numerals, for the sake of simplicity and to avoid an overlapping description. The clamp device of this embodiment is essentially the same in its arrangement as the previous one, except that it is adapted to clamp a pair of workpieces W at the same time, with each sub-frame 20 being divided into two sections 20*a*, 20*b* which can be actuated independently of the other. This means that the actuator assembly 30 has to be arranged for each sub-frame section 20*a*, 20*b*. Each actuator assembly 30 is shown as including a hydraulic cylinder 32.

The clamp device of the embodiment shown in FIGS. 4 and 5 has been compared with a conventional device to carry out the cutting operation with respect to the clamped workpiece and ascertain the difference in the amount of cut end play and the depth of the cutting tool feed pattern on the cut end, the result of which is shown in the following table.

| | Control Value | Prior Art | Invention |
|---|---|---|---|
| cut end play (mm) | 0.2 | 0.35–0.05 | 0.1–0.03 |
| feed pattern depth (mm) | 0.04 | 0.12–0 | 0.04–0 |

It will be readily appreciated from the above table that the conventional clamp device does not always permit the amount of cut end play and the depth of the cutting tool feed pattern to be accommodated within the control value. On the other hand, the present invention makes it possible to minimize the deviation of the amount of cut end play and the depth of the cutting tool feed pattern since the workpiece can be stably clamped by the clamp members adapted to swing about their respective rotational axes in conformity with the surface curvature of the workpiece, without forming undesirable clearances between the workpiece and the clamp members.

The present invention thus provides an improved clamp device which is capable of clamping the workpiece without being adversely affected by the surface curvature of the workpiece, and serves to realize an improved productivity and a higher product quality, i.e. minimized cut end play or cutting tool feed pattern depth.

While the present invention has been described with reference to specific embodiments, it is of course that various variations and/or modifications may be made without departing from the scope of the invention.

What is claimed is:

1. A workpiece clamp device for a cutting apparatus, comprising:

a stationary base frame;

a movable sub-frame mounted on, and adapted to be moved relative to said base frame;

a plurality of first stationary clamp members arranged on a plurality of first rotational shafts mounted on said base frame, said first stationary clamp members being adapted to swing about respective first rotational axes of said first rotational shafts which are in parallel with each other;

a plurality of second clamp members arranged on a plurality of second rotational shafts mounted on said movable sub-frame, said second clamp members being adapted to swing about respective second rotational axes of said second rotational shafts which are in parallel with each other and in parallel with said first rotational axes;

said sub-frame being movable relative to said base frame such that said second clamp members are movable toward said first clamp members to clamp a workpiece therebetween, and movable away from said first clamp members to release said workpiece; and a plurality of stationary support members arranged on a plurality of rotational support shafts mounted on said base frame to support said workpiece thereon, said stationary support members being adapted to swing about respective third rotational axes of said rotational support shafts extending perpendicularly to said first and second rotational axes, wherein the rotational axis of each respective rotational support shaft intersects the rotational axis of each respective first rotational shaft at a point within the stationary base frame.

2. The clamp device of claim 1, wherein said first rotational shafts are arranged opposite to the respective second rotational shafts and aligned therewith in a direction in which said movable sub-frame is moved relative to said base frame.

3. The clamp device of claim 2, wherein said movable sub-frame is movable relative to said base frame in a horizontal direction while maintaining said first and second rotational shafts directed vertically.

4. The clamp device of claim 3, wherein said first and second clamp members each comprises at least one vertical clamp surface.

5. The clamp device of claim 3, wherein said support members each comprises an upper horizontal support surface.

6. The clamp device of claim 1, wherein said first and second clamp members each comprises a main body and at least one shoe element detachably secured to said main body.

7. The clamp device of claim 6, wherein said first and second clamp members each comprises a pair of shoe elements forming a unit which is detachably secured to said main body.

8. The clamp device of claim 6, wherein each shoe element is composed of a resilient material.

9. The clamp device of claim 7, wherein each shoe element is composed of a resilient material.

10. The clamp device of claim 1, wherein said movable sub-frame is divided into a plurality of sections each corresponding to a second clamp member, each section of the sub-frame being associated with an individual actuator means for moving said section relative to said base frame independently of the movement of another one of said sub-frame sections.

* * * * *